US006736038B1

(12) United States Patent
Hong

(10) Patent No.: US 6,736,038 B1
(45) Date of Patent: May 18, 2004

(54) TAPE GUIDE DEVICE FOR AUTOMATIC ROLL TAPE CUTTER

(76) Inventor: Myon Ki Hong, #602, Greenhillvillat Villa, 198-36, Mia 3-Dong, Gangbuk-Gu, Seoul (KR)

( * ) Notice: Subject to any disclaimer, the term of this patent is extended or adjusted under 35 U.S.C. 154(b) by 0 days.

(21) Appl. No.: 10/370,587

(22) Filed: Feb. 24, 2003

(30) Foreign Application Priority Data

Nov. 8, 2002 (KR) ..... 20-2002-0033438

(51) Int. Cl.[7] ..... B26D 7/01

(52) U.S. Cl. ..... 83/156; 83/922; 83/949; 83/649; 83/436.3

(58) Field of Search ..... 83/922, 176, 163, 83/949, 649, 503, 506, 508.2, 436.3, 156; 225/11, 23, 10, 15

(56) References Cited

U.S. PATENT DOCUMENTS 3,747,816 A * 7/1973 Se-Kit ..... 225/11
3,869,884 A * 3/1975 Deadman ..... 68/258
4,103,595 A * 8/1978 Corse ..... 493/362
4,441,392 A * 4/1984 DeLuca ..... 83/337
4,690,344 A * 9/1987 Yokota ..... 242/564.1
4,862,779 A * 9/1989 Nishimura et al. ..... 83/123
5,042,351 A * 8/1991 Rosenthal ..... 83/649
5,048,737 A * 9/1991 Sueda et al. ..... 225/11
5,979,284 A * 11/1999 Granger ..... 83/649
6,112,631 A * 9/2000 VanAlstine ..... 83/589

* cited by examiner

*Primary Examiner*—Allan N. Shoap
*Assistant Examiner*—Phong Nguyen
(74) *Attorney, Agent, or Firm*—Birch, Stewart, Kolasch & Birch, LLP

(57) ABSTRACT

Disclosed is a tape guide device for an automatic roll tape cutter, the tape guide device having a roll tape loaded therein for feeding out a required length of the roll tape and automatically cutting the fed out roll tape, the tape guide device comprising: a tape guiding portion disposed at the inside of in a main body of the tape cutter, and including a plurality of guide rolls which guide the roll tape with its upper and lower surfaces contacting with the rolls, each guide roll positioned at the lower portion of the tape guiding portion having uneven grooves formed on its outer circumferential surface at equal distances, guide rolls positioned at the upper portion of the tape guiding portion being respectively mounted in proximate close to the opposite guide rolls positioned at the lower portion of the tape guiding portion in at least an outlet and an inlet for the tape, and the plurality of guide rolls of the tape guiding portion having a gear ratio set in such a manner that the rotation speed of guide rolls at the outlet side of the roll tape being gradually faster than that of guide rolls at the inlet side of the roll tape, whereby non-adhesive tapes such as strings or color ties in addition to adhesive tape being automatically cut.

7 Claims, 7 Drawing Sheets

[fig.1]
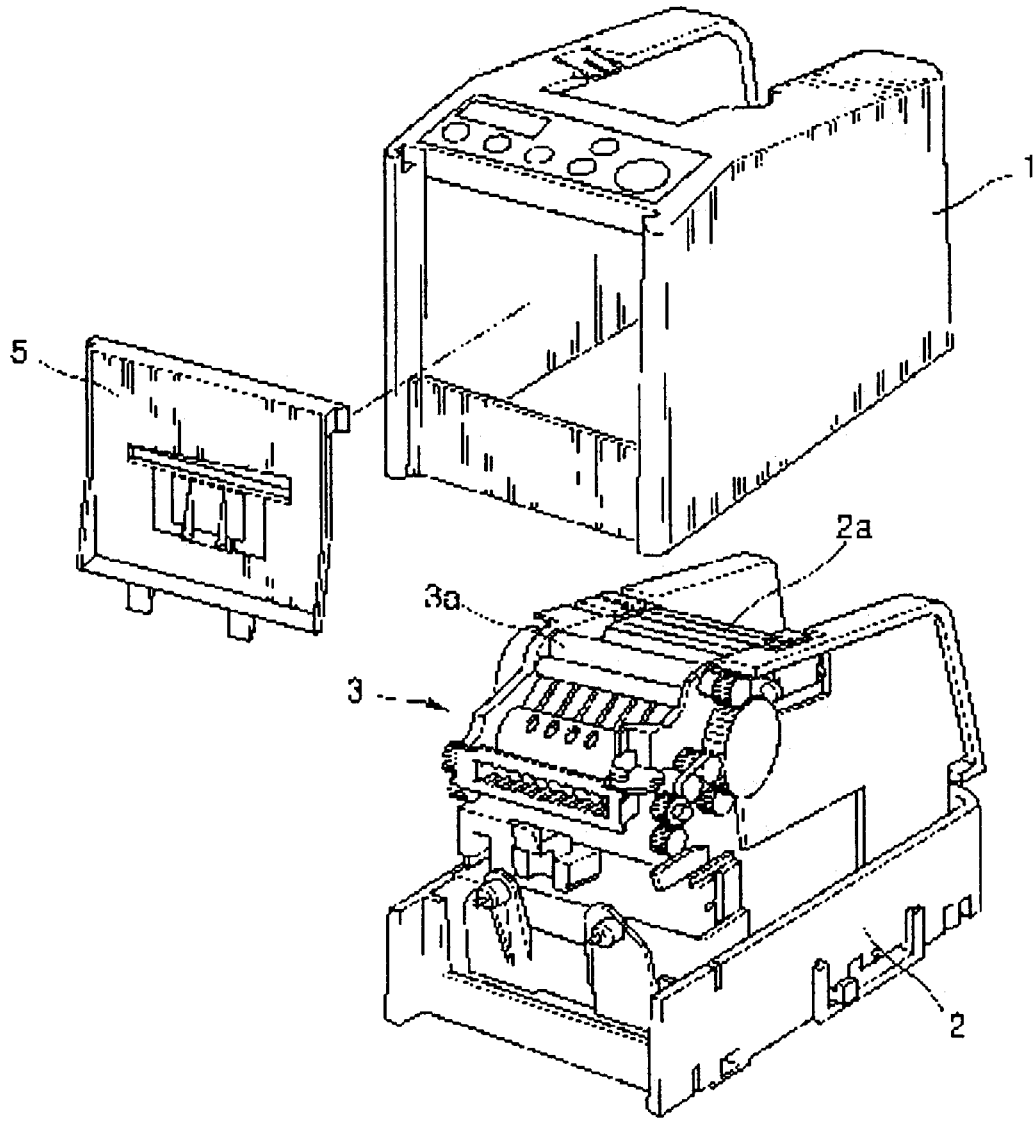

[fig.2]
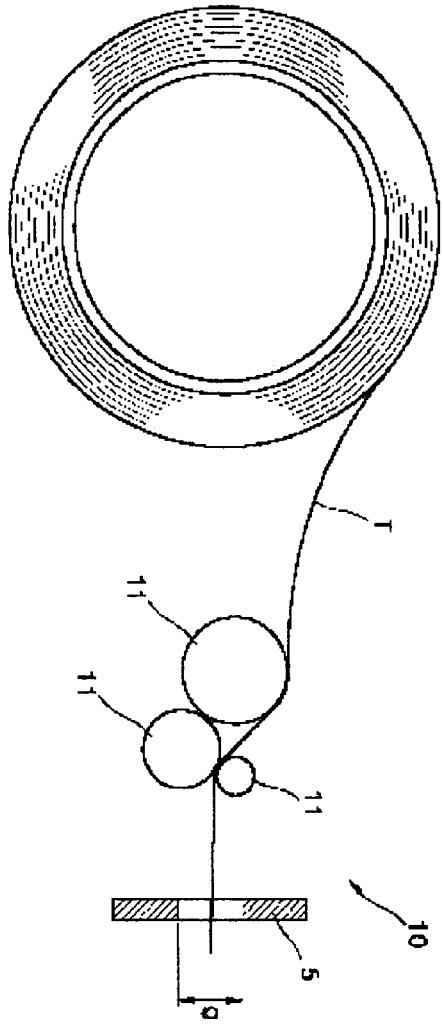
[fig.3]
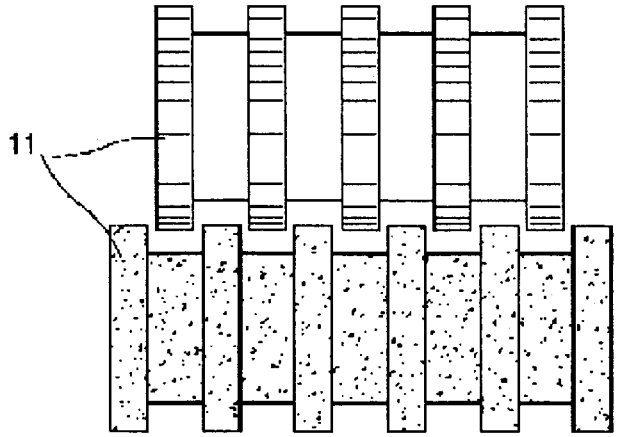

[fig.4]
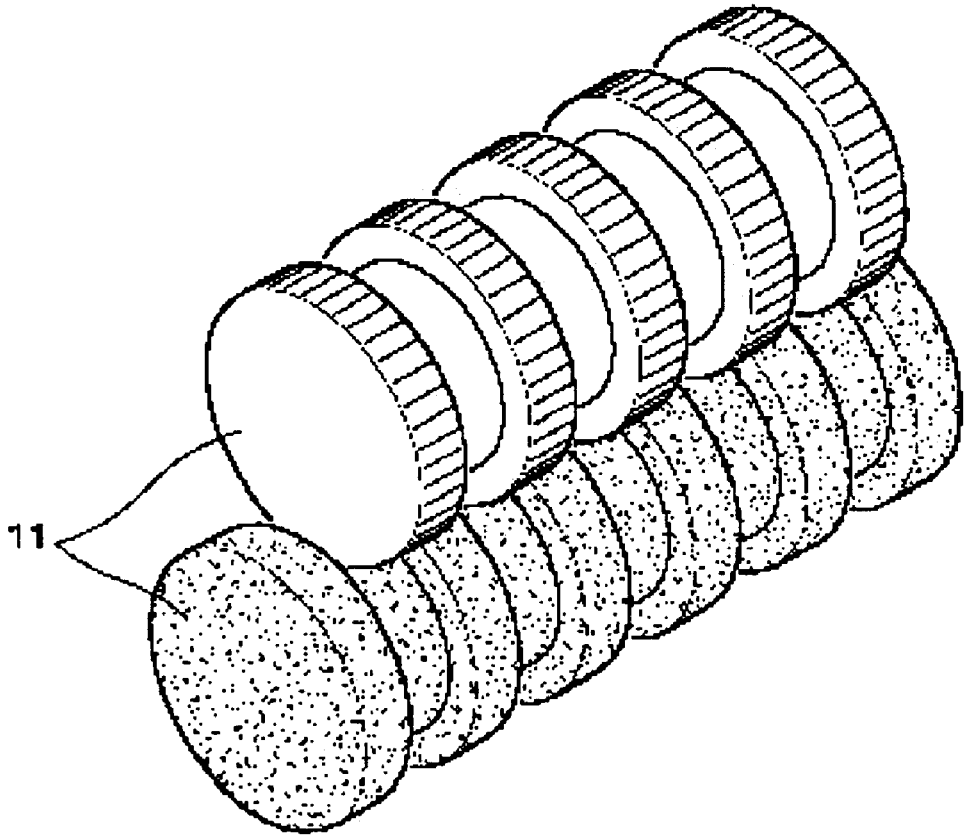

[fig.5]
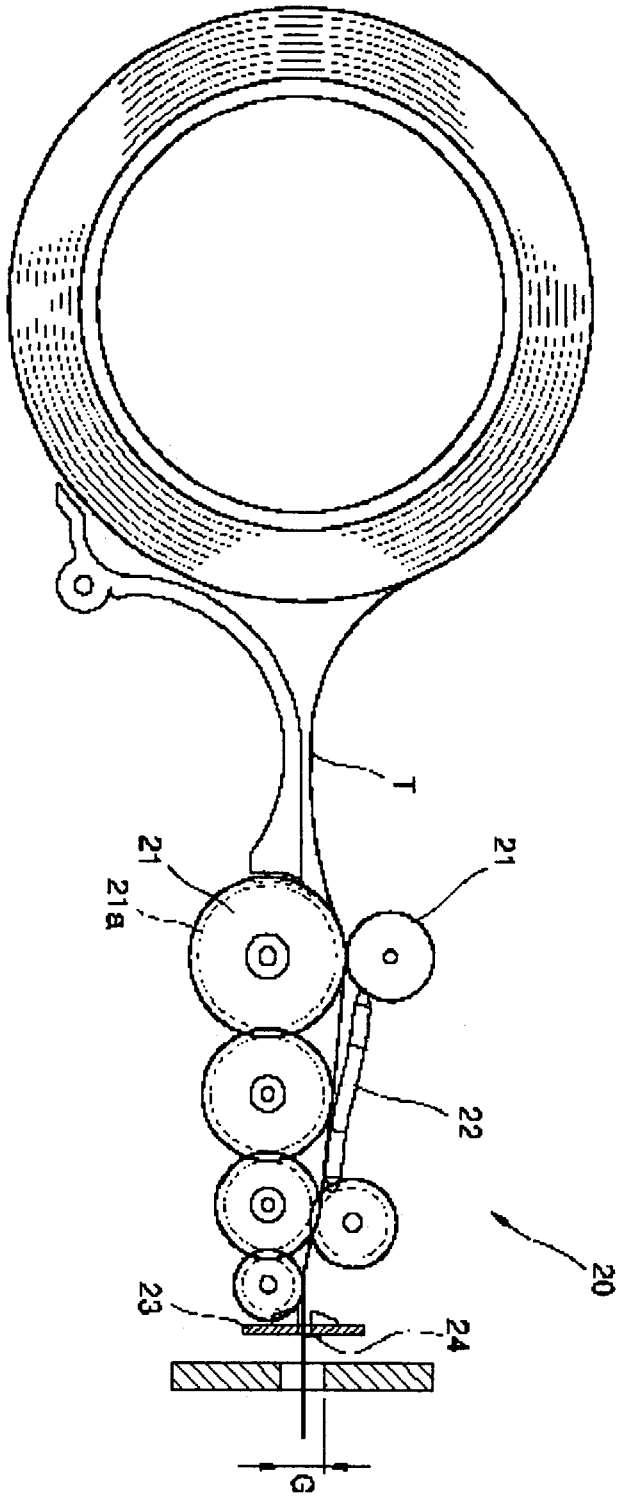

[fig.6]
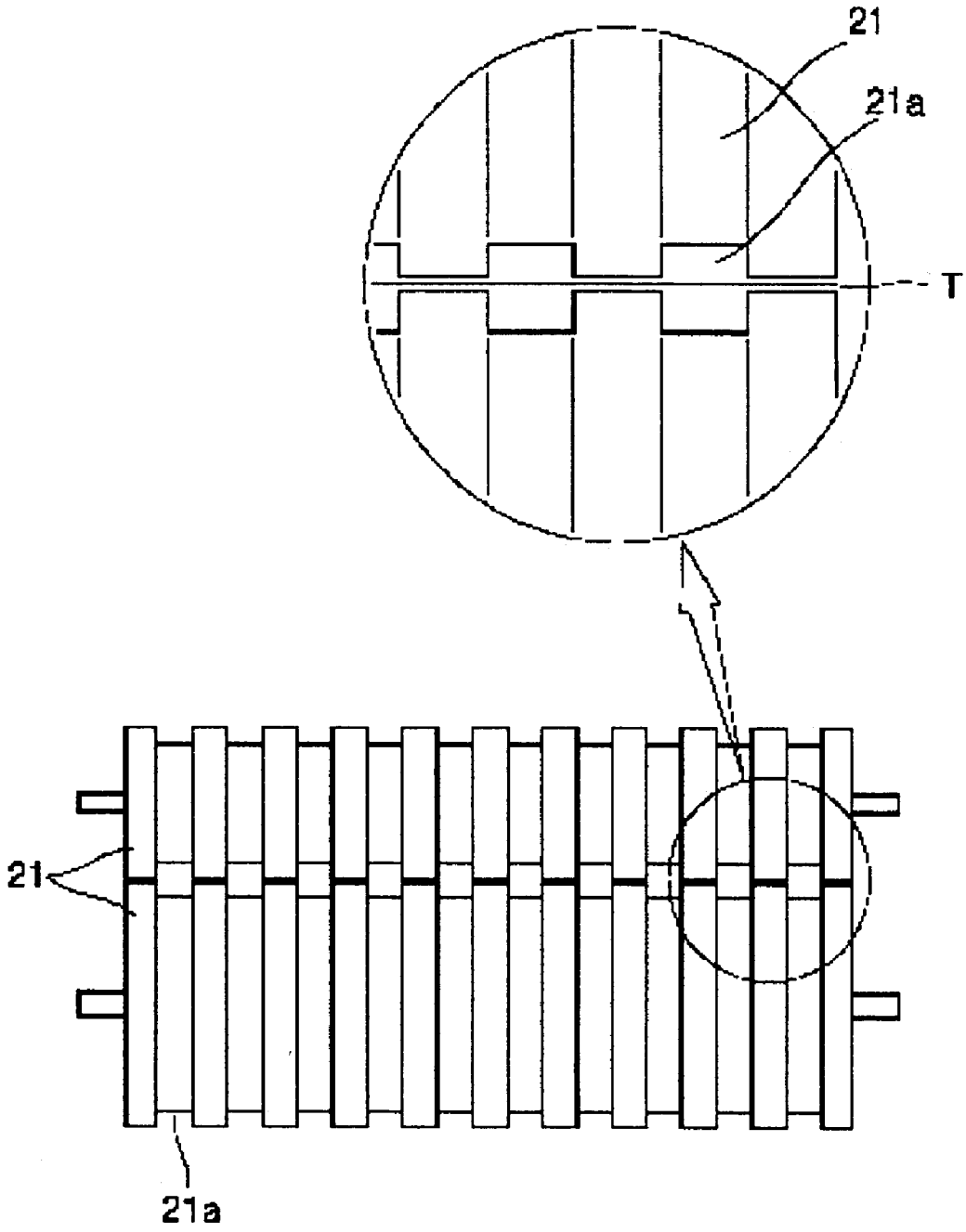

[fig.7]
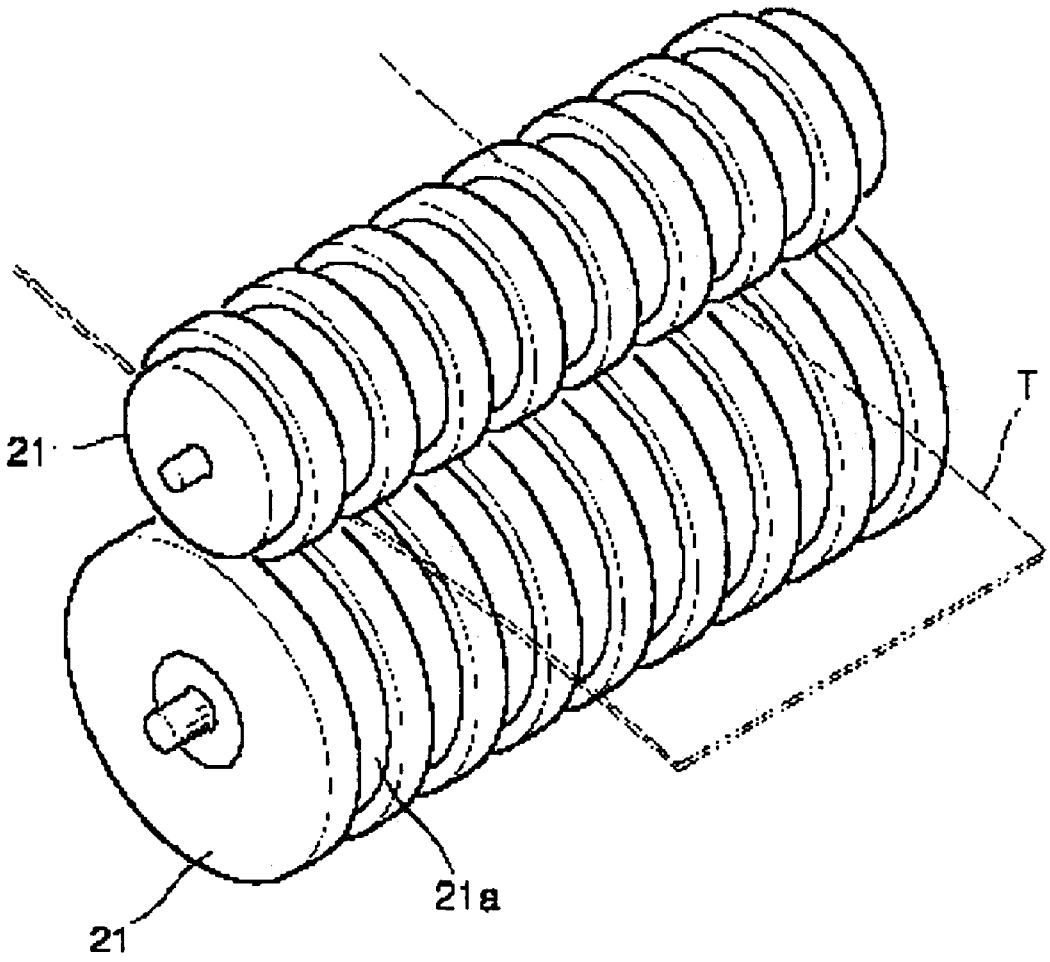

[fig.8]
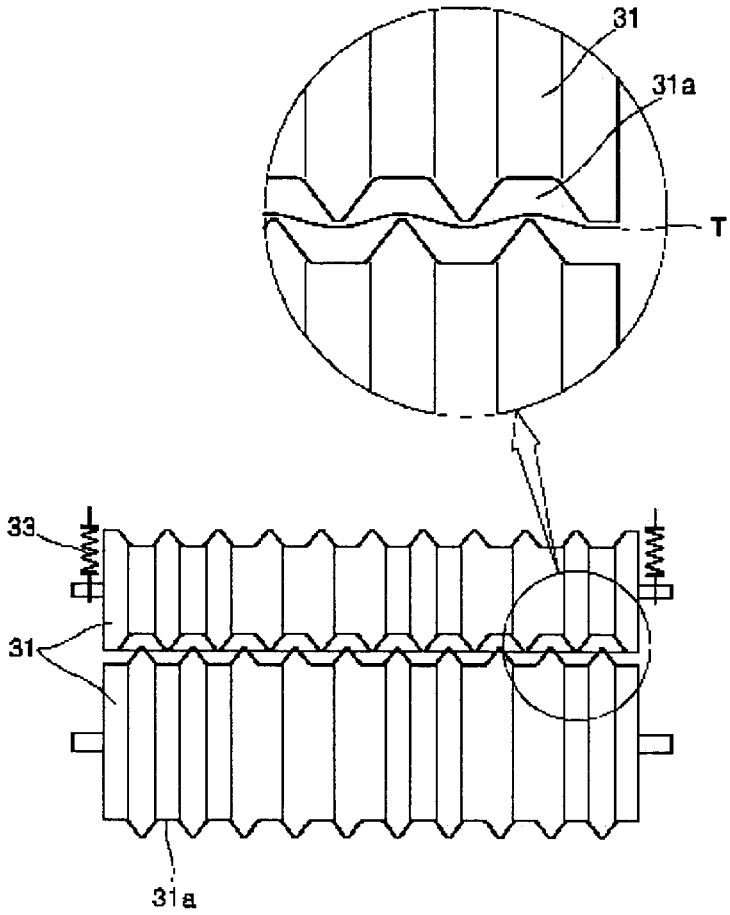
[fig.9]
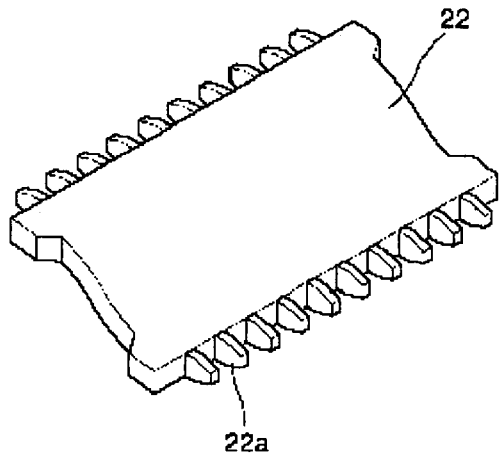

TAPE GUIDE DEVICE FOR AUTOMATIC ROLL TAPE CUTTER

BACKGROUND OF THE INVENTION

1. Field of the Invention

The present invention relates to an automatic roll tape cutter, more particularly, to a tape guide device for an automatic roll tape cutter, which guides an adhesive or non-adhesive tape so as to smoothly feed out and cut the same.

2. Description of the Related Art

In general, when goods are sold in such various stores as department stores or large discount stores, these various goods will be properly packed with a packing material like paper. Such a packing paper is mainly bonded by means of a band-type adhesive tape.

For the purpose of the more efficient and fast packing of goods, a so-called automatic roll tape cutter has been provided and widely used which has a large wound tape, i.e., roll tape contained therein, and, during packing, feeds out a required length of the wound adhesive tape and cuts the same automatically.

Such an automatic roll tape cutter, as shown in FIG. 1 comprises upper and lower cases 1 and 2, a tape feed-out unit 3 installed in the cases 2 and 3 for feeding out a tape by means of a plurality of rollers interlocked with a driver, a tape guide device 4 positioned between a tape supporting portion (not shown) and a roller 3*a* in the tape feed-out unit 3 for guiding the roll tape so as not to be folded during the feed-out of the tape, and a tape cutter 5 openably installed in front of the upper case 1 for cutting the fed-out tape.

The tape cutter comprises a fixed blade and a movable blade (not shown) that are engaged with each other for cutting papers or thin plates like a general shearing machine. The tape cutter is constructed in such a manner that the movable blade is positioned slantingly at a proper angle to minimize a cutting load and to facilitate the cutting and that the tape is continuously cut at one side thereof while the movable blade is ascended and descended with respect to the fixed blade.

As shown in FIGS. 2 to 4, such a roll tape cutter according to the prior art includes a tape guiding portion 10 wherein a plurality of guide rolls 11 is constructed in such a manner as to guide the movement of a roll-type tape T supported by a tape supporting portion when it is fed out. In this case, the guide rolls for supporting the bottom surface of the tape T is made of rubber or synthetic resin and the guide rolls for supporting the upper surface of the tape T is made of metallic material.

A plurality of guide protrusions are formed on an outer circumferential surface of each guide roll 11 at equal distances, so that the guide rolls 11 are coupled together with one another in such a manner that guide protrusions of one guide roll are arranged alternately with the those of other guide roll. The surface of the guide roll 11 made of metallic material is undergone a knurling process to guide the roll tape smoothly.

The tape guide device of the prior art, however, has problems in that a scratch is formed on the surface of the tape T by the knurled surface of the guide roll 11 made of metallic material, causing damage to the tape. Especially, in the case where a transparent tape is used, the scratch is visible to the naked eye, thereby avoiding the use of the roll tape cutter.

Further, since it is difficult to accurately guide the movement of the tape, a distance (g) between upper and lower blades is formed widely at the outlet of the tape guiding portion 10 in the tape cutter after taking into account the sufficient movement space of a roll tape, which doing an injury to user.

Still further, in the workplace where the tape cutter is used, various materials for packing such as paper bags, non-adhesive tapes, strings or color ties, etc. are generally used in addition to the adhesive tape, but the use of these packing materials requires a separate cutting instrument. For the tape cutter of the prior art wherein an adhesive tape is guided through the guide rolls with its adhesive surface attached to the roll during guiding, however, users suffer from an inconvenience of preparing a separate cutting instrument since the non-adhesive packing materials could not be cut.

SUMMARY OF THE INVENTION

An object of the present invention is to solve the problems of the conventional tape cutter by providing a tape guide device for an automatic roll tape cutter wherein an adhesive tape and a non-adhesive tape (hereinafter, referred to as 'a tape') such as a string or a color tie could be cut while being accurately guided.

Another object of the present invention is to provide a tape guide device for an automatic roll tape cutter wherein a tape is guided with its adhesive surface not damaged.

According to an aspect of the present invention, there is provided a tape guide device for an automatic roll tape cutter, the tape guide device having a roll tape loaded therein for feeding out a required length of the roll tape and automatically cutting the fed out roll tape, the tape guide device comprising: a tape guiding portion disposed at the inside of a main body of the tape cutter, and including a plurality of guide rolls which guide the roll tape with its upper and lower surfaces contacting with the rolls, each guide roll positioned at the lower portion of the tape guiding portion having grooves and projections of which noses are tapered formed on its outer circumferential surface at equal distances, guide rolls positioned at the upper portion of the tape guiding portion being respectively mounted in proximate close to the opposite guide rolls positioned at the lower portion of the tape guiding portion in at least an outlet and an inlet for the tape, and the plurality of guide rolls of the tape guiding portion having a gear ratio set in such a manner that the rotation speed of guide rolls at the outlet side of the roll tape being gradually faster than that of guide rolls at the inlet side of the roll tape.

Preferably, the upper guide roll of the tape guiding portion may have uneven grooves formed on its circumferential surface.

Preferably, the tape guide device of the present invention further may include a supporting plate for supporting the tape so as not to be derailed between the upper guide rolls in the tape guiding portion.

Also, preferably, the tape guide device of the present invention further may include a tape guiding plate having a brush attached thereon for removing contaminants stuck to the roll tape and static electricity at the outlet of the tape guiding portion.

BRIEF DESCRIPTION OF THE DRAWINGS

Other objects, features and advantages of the tape guide device of the present invention will be apparent from the following detailed description of the preferred embodiment of the invention in conjunction with the accompanying drawings, in which:

FIG. 1 is an exploded perspective view of a conventional tape cutter;

FIG. 2 is a cross-sectional view of a tape, guiding portion of the tape cutter according to the prior art;

FIG. 3 is a front view of the prior tape guiding portion of the tape cutter;

FIG. 4 is a perspective view of the prior guide rolls of the tape guiding portion of the tape cutter;

FIG. 5 is a cross-sectional view of a tape guiding portion of the tape cutter according to the present invention;

FIG. 6 is a front view of the tape guiding portion of the tape cutter according to the present invention;

FIG. 7 is a perspective view of the guide rolls of the tape guiding portion of the tape cutter according to the present invention;

FIG. 8 is a cross-sectional view of another embodiment of guide rolls according to the present invention; and FIG. 9 is a perspective view of a supporting plate according to the present invention.

DETAILED DESCRIPTION OF THE PREFERRED EMBODIMENT

The embodiments of the tape guide device for an automatic roll tape cutter according to the present invention will be explained below in detail by referring to FIGS. 5 through 9.

FIG. 5 is a cross-sectional view of a tape guiding portion of the tape cutter according to the present invention; FIG. 6 is a front view of the tape guiding portion of the tape cutter according to the present invention; FIG. 7 is a perspective view of the guide rolls of the tape guiding portion of the tape cutter according to the present invention; FIG. 8 is a cross-sectional view of another embodiment of guide rolls of the present invention; and FIG. 9 is a perspective view of a supporting plate according to the present invention.

As shown in the drawings, a tape guide device for an automatic roll tape cutter a tape is contained therein, which feeds out a required length of the tape and automatically cuts the tape, comprises a tape guiding portion 20 for guiding the tape T in a main body of the tape cutter. In the tape guiding portion are mounted a plurality of guide rolls with which the upper and lower surfaces of the tape T are in contact during guiding. A surface of the guide roll 21 mounted at an inlet and an outlet of the tape guiding portion 20 could be formed with not only even and plain surface, but also patterned surface. Either of the upper and lower guide rolls or both of the guide rolls have the surface on which a plurality of uneven grooves are formed at equal distance. The uneven groove could be generally of a rectangular shape or of a round shape at its edge portion. On upper and lower guide rolls 21 installed to inlet for the tape T, uneven grooves 21*a* are closely formed so that the tape is moved through contact therewith.

Each guide roll of the tape guiding portion, meanwhile, is preferably made of either rubber or silicon in order to prevent an adhesive side of the tape T from being damaged.

Also, as is shown in FIGS. 7 and 8, the upper and lower guide rolls 31 installed at the outlet of the tape guiding portion 20 have projections of which noses 32 are tapered on the outer circumferential surface in such a way as to arrange the protrusions of the upper guide roll alternatively with those of the lower guide roll, with the result that the tape will be stably guided with its contact area with the guide rolls 31 minimized.

Preferably, upper guide roll of the guide rolls 31 also has a spring member 33 at both end sides so that it is elastically moved conformity with thickness of the pate to be guided.

A supporting plate 22 is provided between upper guide rolls on upper side of the tape guiding portion 20 so as to support the tape T not to be derailed, which has, at its both ends, grooves 22*a* and projections of which noses are tapered are engageable with uneven grooves of the guide rolls.

Preferably, the gear ratio of guide rolls positioned from inlet to outlet of the tape in tape guiding portion 20 is set in such a manner that the guide rolls 21 at inlet are driven faster than the guide rolls 31 at outlet, thereby smoothly feeding out the tape.

At the outlet of the tape guiding portion 20 is installed a guiding plate 23 for guiding a leading part of the tape T, where a brush 24 is mounted so as to remove contaminants and static electricity in the tape T.

Accordingly, when the leading part of the tape T wound in roll type is introduced into the tape guiding portion 20, the tape T is passed through guide rolls 21 in the tape guiding portion 20 so that since the tape will be moved in a state to be inserted into uneven grooves 21*a* of the guide rolls 21 and the guide rolls have different gear ratio to maintain proper tension, the tape will be smoothly led out without being damaged with its adhesive side.

Also, when the leading part of the tape is moved, the tape is guided by the supporting plate 22 installed between upper guide rolls, thereby preventing the leading part from being derailed.

The tape T is then supplied to a cutting unit while guided by the guiding plate 23 installed at outlet of the tape guiding portion 20 so that it could be accurately guided without shaking of the leading part thereof, which permits the distance G between upper and lower cutting blades installed in the cutting unit to be narrowed.

The tape passing through the guiding plate 23 comes to be in contact with the brush 24 so that contaminants and static electricity in the tape will be removed.

According to the present invention that has been described above, a tape guide device for an automatic roll tape cutter for guiding the movement of the tape is provided with guide rolls with uneven grooves formed thereon, so that the tape will be accurately guided and fed out while maintaining proper tension by continuous guide rolls.

Further, the tape guide device of the present invention comprises a guiding plate for removing contaminants and static electricity in the tape during guiding of the leading part of the tape so that distance between the upper and lower cutting blades in the tape cutter will be minimized, thereby preventing generation of safety accidents.

Still further, the tape guide device of the present invention could be utilized with multipurpose to simply cut a non-adhesive string or a color tie for binding opening of paper bag in addition to an adhesive tape.

Accordingly, the tape guide device of the present invention could be much available in packing goods sold by such various stores as department stores or large discount stores.

It should be understood that although preferred embodiments of the present invention have been described in order to illustrate the invention, the invention includes various modifications and equivalents to the disclosed embodiments, only some of which have been mentioned above. It is intended that the present invention include all such modifications and equivalents falling within the scope of the appended claims.

What is claimed is:

1. A tape guide device for an automatic roll tape cutter, the tape guide device having a roll tape loaded therein for feeding out a required length of the roll tape and automatically cutting the fed out roll tape, the tape guide device comprising:

a tape guiding portion including a plurality of guide rolls which guide the roll tape with the upper and lower surfaces of the roll tape contacting the rolls, each guide roll positioned at the lower portion of the tape guiding portion having grooves and projections of which noses are tapered formed on an outer circumferential surface thereof at equal distances from each other, guide rolls positioned at the upper portion of the tape guiding portion being respectively mounted proximately to the opposite guide rolls positioned at the lower portion of the tape guiding portion in at least an outlet and an inlet for the tape, and the plurality of guide rolls of the tape guiding portion having a gear ratio set in such a manner that the rotation speed of guide rolls at the outlet side of the roll tape is gradually faster than that of guide rolls at the inlet side of the roll tape.

2. The tape guide device for an automatic roll tape cutter as claimed in claim 1, wherein the grooves and projections of which noses are tapered formed on the guide rolls of the tape guiding portion are made of either rubber or silicon.

3. The tape guide device for an automatic roll tape cutter as claimed in claim 1, further comprising a supporting plate for supporting the tape so as not to be derailed between the upper guide rolls in the tape guiding portion.

4. The tape guide device for an automatic roll tape cutter as claimed in claim 1, wherein the upper guide roll positioned at the rearmost end among the guide rolls of the tape guiding portion has a spring mounted thereto so as to be elastically moved according to the thickness of the roll tape.

5. The tape guide device for an automatic roll tape cutter as claimed in claim 1, wherein the upper guide rolls of the tape guiding portion have grooves and projections of which noses are tapered formed at equal distances on outer circumferential surfaces thereof.

6. The tape guide device for an automatic roll tape cutter as claimed in claim 3, further comprising a tape guiding plate at the outlet side of the tape guiding portion.

7. The tape guide device for an automatic roll tape cutter as claimed 1, wherein said grooves and projections of which noses are tapered on said upper and lower guide rolls, respectively, are spaced laterally from grooves and projections on an opposite guide roll.

* * * * *